US008510887B2

(12) United States Patent
Hasse et al.

(10) Patent No.: US 8,510,887 B2
(45) Date of Patent: Aug. 20, 2013

(54) METHOD FOR ELIMINATING FOAM IN A DRUM WASHING MACHINE AND DRUM WASHING MACHINE SUITABLE THEREFOR

(75) Inventors: Torsten Hasse, Nauen (DE); Ingo Schulze, Panketal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 856 days.

(21) Appl. No.: 12/671,045

(22) PCT Filed: Jul. 9, 2008

(86) PCT No.: PCT/EP2008/058900

§ 371 (c)(1),
(2), (4) Date: Feb. 9, 2010

(87) PCT Pub. No.: WO2009/016009

PCT Pub. Date: Feb. 5, 2009

(65) Prior Publication Data

US 2010/0199440 A1 Aug. 12, 2010

(30) Foreign Application Priority Data

Aug. 1, 2007 (DE) ..... 10 2007 036 041

(51) Int. Cl.

| | |
|---|---|
| ***D06F 33/02*** | (2006.01) |
| ***D06F 39/06*** | (2006.01) |
| ***D06F 39/08*** | (2006.01) |
| ***D06F 35/00*** | (2006.01) |

(52) U.S. Cl.

USPC ..... 8/159; 68/12.02; 68/12.05; 68/12.14; 68/23.5; 68/207; 68/208

(58) Field of Classification Search

USPC ..... 8/158, 159; 68/12.02, 12.05, 12.14, 68/12.19, 23.5, 184, 207, 208

See application file for complete search history.

(56) References Cited

U.S. PATENT DOCUMENTS

| | | | | |
|---|---|---|---|---|
| 5,596,889 | A * | 1/1997 | Guerra et al. | 68/12.02 |
| 5,647,232 | A * | 7/1997 | Boldt et al. | 68/12.02 |
| 5,890,247 | A * | 4/1999 | Erickson et al. | 8/158 |
| 6,269,666 | B1 * | 8/2001 | Whah et al. | 68/12.02 |
| 7,716,769 | B2 * | 5/2010 | Ha et al. | 8/158 |
| 2001/0047670 | A1 | 12/2001 | Whah et al. | |
| 2005/0197264 | A1 | 9/2005 | Czyzewski et al. | |
| 2006/0248658 | A1 | 11/2006 | Ha et al. | |
| 2007/0151312 | A1 * | 7/2007 | Bruce et al. | 68/3 R |

FOREIGN PATENT DOCUMENTS

| | | | |
|---|---|---|---|
| DE | 4104151 | A1 | 8/1992 |
| DE | 4334969 | A1 | 4/1994 |
| DE | 19846248 | A1 | 4/2000 |
| DE | 102006027197 | A1 | 12/2007 |

(Continued)

*Primary Examiner* — Joseph L Perrin

(74) *Attorney, Agent, or Firm* — James E. Howard; Andre Pallapies

(57) ABSTRACT

A drum-type washing machine that includes a program controller, a drum rotatably mounted in a detergent solution tub, a detergent solution discharge system disposed at a base of the detergent solution tub having a detergent solution drain pump, a sensor for determining a foam level and/or a negative time gradient of a liquid/air mixture contained in the detergent solution tub, a drive motor for the drum that adjusts a rotation of the drum to eliminate foam in the drum-type washing machine, and a water supply system that adds a small volume of water continuously or discontinuously if foam is detected by the sensor during the run-up to spin speed of the drum with the detergent solution drain pump switched on continuously or discontinuously.

17 Claims, 1 Drawing Sheet

(56) References Cited

FOREIGN PATENT DOCUMENTS

| | | | | |
|---|---|---|---|---|
| EP | 0268155 | A2 | | 5/1988 |
| EP | 0278239 | A1 | | 8/1988 |
| EP | 0724036 | A1 | | 7/1996 |
| JP | 11042387 | A | * | 2/1999 |
| JP | 2008295531 | A | * | 12/2008 |
| WO | WO 2007074037 | A1 | * | 7/2007 |

* cited by examiner

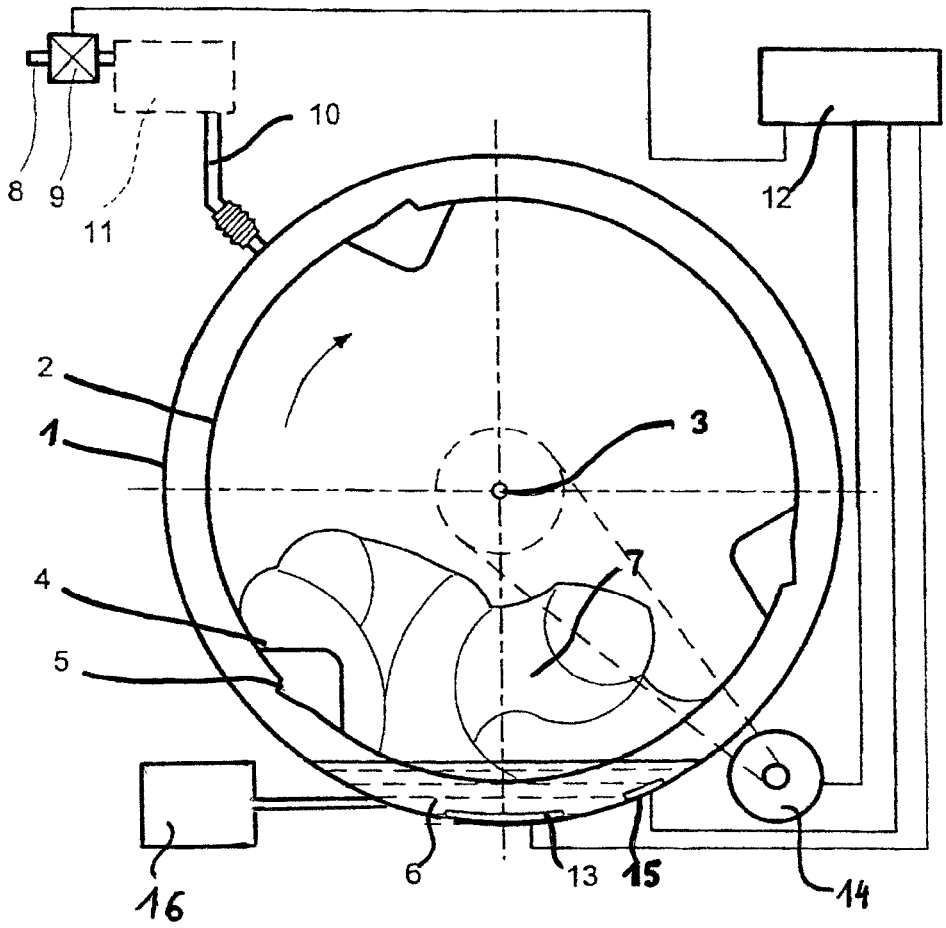
8
9
11
10
12
2
1
3
4
7
5
6
13
15
14
16

METHOD FOR ELIMINATING FOAM IN A DRUM WASHING MACHINE AND DRUM WASHING MACHINE SUITABLE THEREFOR

BACKGROUND OF THE INVENTION

The invention relates to a method for eliminating foam in a drum-type washing machine and to a drum-type washing machine that is suitable for performing said method. The invention relates in particular to a method for eliminating foam that is present in a detergent solution tub of a drum-type washing machine having a program controller for controlling a program sequence comprising a sequence of steps which include an adding of water and a rotating of the drum, as well as to a drum-type washing machine that is suitable therefor.

In conventional drum-type washing machines, spinning is performed at high revolutions already after the main wash and the rinse cycles. If there is a lot of foam present or if a lot of foam is produced during spinning, the detergent solution drain pump will not convey the foam/detergent solution mixture. Thus, if foam is detected during the pump's drain-off operation, spinning will not be performed, or in the case of foam being detected during a spinning cycle, spinning will be aborted. Moreover, the foam can escape from the apertures in the detergent solution tub as well as from the detergent solution tub ventilation and the filler hose. Early foam detection and efficient measures for eliminating the foam are therefore important.

According to DE 41 04 151 A1, the foam is destroyed by switching on a heater. In order to destroy the foam in the wider environment of the heater also, the drum is rotated slowly so that further foam reaches the heater and is destroyed there by the introduction of heat.

DE 43 34 969 A1 discloses a device for destroying detergent foam which has an apparatus for generating hot air which is introduced through a supply line in the detergent solution tub wall between the detergent solution tub and the drum.

Methods for removing foam in a detergent solution tub of a drum-type washing machine are also known from DE 102 34 472 A1 and DE 198 46 248 A1.

DE 102 34 472 A1 describes a method for eliminating foam in a detergent solution tub of an electronically controlled drum-type washing machine following a program step that is provided for draining water from the detergent solution tub, comprising a detergent solution discharge system disposed at the base of the detergent solution tub, having a detergent solution drain pump and having a sensor for determining the level of the liquid contained in the detergent solution tub. The waveform of the sensor signal (P) that is recorded during the operation of the detergent solution drain pump includes a gradient $\Delta p/\Delta t_n$ compared to $\Delta p_{n-1}/\Delta t_{n-1}$ which indicates the presence of foam, whereupon a foam treatment measure adapted to the gradient is then initiated.

In EP 0 278 239 A1, excessive foam formation in the main wash cycle which can be observed during the heating of detergent solution in the detergent solution tub is eliminated by addition of a limited amount of cold water and/or by temporarily switching off the detergent solution heater.

In addition, usually in special method sequences, the foam is removed by suitable rinse baths while avoiding as far as possible the input of mechanical energy (by long drum idle times, for example).

A disadvantage with the known methods is that they sometimes lead to a considerable lengthening of the overall wash program, greatly increased water consumption and poor results during spinning.

BRIEF SUMMARY OF THE INVENTION

It was therefore the object of the invention to provide a method by means of which the foam being produced in a washing machine can be more effectively combated than is possible with conventional methods. A further object of the invention was to disclose a drum-type washing machine that is suitable for performing said method.

The subject matter of the present invention is therefore a method for eliminating foam detected in a drum-type washing machine having a program controller for controlling a program sequence, a drum rotatably mounted in a detergent solution tub, a water supply system, a detergent solution discharge system disposed at the base of the detergent solution tub having a detergent solution drain pump, a drive motor for the drum, and a sensor for determining a foam level $h_s$ and/or a negative time gradient of the foam level ($dh_s/dt$) of a liquid/air mixture contained in the detergent solution tub, wherein if foam is detected by the sensor during a run-up to spin speed of the drum, i.e. a continuous or discontinuous increase in the rotational speed of the drum, a small volume of water is added continuously or discontinuously, with the detergent solution drain pump being switched on continuously or discontinuously.

The water supply system is generally directed at the laundry contained in the drum or into a space between the drum and the detergent solution tub.

In the method according to the invention, a small volume of water is generally added continuously or discontinuously after detergent solution has been pumped away.

In a preferred embodiment variant of the method according to the invention, the foam level $h_s$ during a spinning cycle is monitored by means of the sensor and a rotational speed of the drum controlled as a function of the foam level $h_s$.

It is particularly preferred in this case for the rotational speed to be reduced if there is an increase in the foam level $h_s$, for the rotational speed to be maintained if the foam level $h_s$ is maintained, and/or for the rotational speed to be increased if there is a reduction in the foam level $h_s$.

A maximum volume of water being supplied during the run-up to spin speed is preferably adjusted to the amount of laundry contained in the drum. Toward that end, a volume of water can be predefined, for example as a function of the amount of laundry loaded into a drum. Alternatively, a load detection measure known per se can be implemented in the drum-type washing machine. A load detection measure can be implemented for example via the volume of water supplied and in particular by means of a comparison between measured hydrostatic pressures and volume of water supplied.

If a maximum foam level $h_{smax}$ is exceeded, the rotational speed is generally reduced until the drum comes to a stop. The maximum foam level $h_{smax}$ is preferably adjusted to match the amount of laundry contained in the drum.

The sensor can be a single sensor or a system consisting of a plurality of sensors. Equally, the term sensor, in addition to including the actual sensor, preferably also implies a corresponding system for registering and transmitting the data to a program controller.

In preferred embodiment variants of the invention, the sensor is an optical measuring system, a conductometric measuring system, a capacitive measuring system or a pressure measuring system.

In the event that a pressure measuring system is employed, the latter is preferably used in addition for regulating a water level during a wash and/or rinse cycle.

If a pressure measuring system is used, a hydrostatic pressure p and a negative time gradient of the hydrostatic pressure (dp/dt) of a liquid/air mixture contained in the detergent solution tub are preferably measured as a metric for the foam level $h_s$ and/or a negative time gradient of the foam level ($dh_s/dt$) of a liquid/air mixture contained in the detergent solution tub.

In a preferred embodiment variant of the invention, the continuously supplied volume of water amounts to 0.5 to 1.5 l/min. In a preferred alternative embodiment variant, the discontinuously supplied volume of water amounts to 0.2 to 21 in each case.

In a quite especially preferred embodiment variant, the invention is a method for eliminating foam detected in a drum-type washing machine having a program controller for controlling a program sequence, a drum rotatably mounted in a detergent solution tub, a water supply system, a detergent solution discharge system disposed at the base of the detergent solution tub having a detergent solution drain pump, a drive motor for the drum, a heater and a sensor for determining a hydrostatic pressure p and/or a negative time gradient of the hydrostatic pressure (dp/dt) of a liquid/air mixture contained in the detergent solution tub, wherein the following steps A) to F) are performed:

A) If the drum is stationary or rotating slowly, preferably if the drum is stationary, discharging of the liquid/air mixture by the pump and after a predefined time $\Delta t_1$, measuring of the hydrostatic pressure p and/or of the negative time gradient of the hydrostatic pressure (−dp/dt);

B) comparing of the hydrostatic pressure p measured in step A) with a predefined threshold value $p_1$ for the hydrostatic pressure p and/or comparing of the negative time gradient of the hydrostatic pressure (−dp/dt) measured in step A) with a predefined threshold value $(-dp/dt)_i$ for the negative time gradient of the hydrostatic pressure (−dp/dt), and C) if the conditions $(-dp/dt)<(-dp/dt)_1$ and $p>p_1$ are present, performing of the following steps C1) to C3), C1) adding of a predefined small volume of water $\Delta V_i$, C2) rotating of the drum at a predefined low rotational speed $U_1$, preferably in alternating directions, possibly interrupted by a stopping of the drum, C3) discharging of the liquid/air mixture by the pump, measuring of the hydrostatic pressure p and repetition of step B), D) if the condition $(-dp/dt)>(-dp/dt)_i$ or $p<p_i$ is present, performing of the following steps D1) to D4)

D1) at a pressure p which is greater than a predefined pressure $p_2$, where $p_2 \leqq p \leqq p_1$, adding of a predefined small volume of water $\Delta V_j$ and rotating of the drum, with the pump switched on, at a rotational speed of $U_2>U_1$, wherein after a predefined time interval $\Delta t_2$ the to hydrostatic pressure p is measured and one of the following steps D2) to D4) is performed as a function of a change in the hydrostatic pressure p after the time interval $\Delta t_2$ has elapsed;

D2) if the hydrostatic pressure p increases, adding of a predefined small volume of water $\Delta V_j$, reduction in the rotational speed $U_1$ by an amount $\Delta U_i$, and rotating of the drum at the rotational speed $U_1$-$\Delta U_i$;

D3) if the hydrostatic pressure p remains the same, adding of a predefined small volume of water $\Delta V_j$ and rotating of the drum at an unchanged rotational speed $U_1$;

D4) if the hydrostatic pressure p decreases, adding of a predefined small volume of water $\Delta V_j$, increasing of the rotational speed $U_1$ by an amount $\Delta U_j$ and rotating of the drum at the rotational speed $U_i$-$\Delta U_j$;

D5) measuring of the hydrostatic pressure p after a time interval $\Delta t_2$ has elapsed, and if $p>p_t$ and a sum $\Sigma\Delta V_{i,j}$ of the added volumes of water $\Delta V_{i,j}$ is less than a predefined maximum permissible volume of water $W_z$, performing of one of the steps D2) to D4) as a function of the change in pressure that occurred after the time interval $\Delta t_2$;

E) if $\Sigma\Delta V_{i,j}>W_z$, repetition of steps A) to D5);

F) if a pressure $p<p_2$, increasing of the rotational speed U of the drum until a predefined maximum rotational speed $U_{max}$ is reached.

In the aforesaid step A), the slow rotation of the drum takes place preferably at a rotational speed in the range of 10 to 40 revolutions per minute, for example at 35 revolutions per minute. In step A) in addition, the negative time gradient of the hydrostatic pressure (−dp/dt) is advantageously measured. The presence of a liquid/air mixture (foam) is generally revealed in a plotting of hydrostatic pressure p over time t during a pump discharging operation, by a more or less pronounced kink that indicates a decrease in the negative time gradient of the hydrostatic pressure (−dp/dt).

In a preferred embodiment variant of the method according to the invention, the predefined water volume $\Delta V$, and/or $\Delta V_j$ is adjusted to take account of a loading of the drum with laundry.

The predefined volume of water $\Delta V$, and/or $\Delta V$, generally amounts to 0.5 to 2 liters. The volumes of water $\Delta V_i$, and $\Delta V_j$ can be the same or different. Preferably the volumes of water $\Delta V_i$ and $\Delta V_j$ are set such that both are equal.

According to the invention the low rotational speed $U_1$ preferably lies in the range of 15 to 45 revolutions per minute. Preferably the rotational speed $U_2$ amounts to at least 100 revolutions per minute.

In the aforesaid preferred method, steps C2) and C3) are preferably performed simultaneously.

In step F), if a pressure $p<p_2$ applies, the rotational speed U of the drum is increased until a predefined maximum rotational speed $U_{max}$ is reached which preferably lies in the range of 900 to 1100 revolutions per minute. The increase in the rotational speed can take place gradually or in one or more increments.

The time intervals $\Delta t_1$ and $\Delta t_2$ can be the same or different. Preferably they are the same.

Foam detection can be carried out before the method according to the invention is performed.

Typically, the presence of foam (liquid/air mixture) is detected via a pressure build-up during washing or spinning or via a greatly slowed decrease in pressure during the pump discharging operation.

Foam detection can also be carried out by way of a conductance measurement using two electrodes in the lower region of the detergent solution tub. Foam detection is also possible during a spinning cycle by means of an evaluation of the nominal/actual rotational speed difference. With foam detection based on evaluation of the nominal/actual rotational speed difference, use is made of the fact that the foam can act as a brake on a rotating drum, thereby resulting in a difference between the nominal and the actual rotational speed. In this case the association between a specific concentration of foam and the nominal/actual difference is generally stored in a data memory of the drum-type washing machine.

If foam is detected during spinning, the spinning cycle is aborted and the method according to the invention performed.

The invention also relates to a drum-type washing machine having a program controller for controlling a program sequence of a drum rotatably mounted in a detergent solution tub, a water supply system, a detergent solution discharge system disposed at the base of the detergent solution tub having a detergent solution drain pump, a drive motor for the drum, a sensor for determining a foam level $h_s$ and/or a negative time gradient ($dh_s/dt$) of a liquid/air mixture contained in the detergent solution tub, as well as switching means for rotating, accelerating, braking and/or stopping the drum, wherein the switching means can perform the above-described method according to the invention. Preferably the drum-type washing machine according to the invention additionally has a heater.

The method and the drum-type washing machine of the present invention enable fast and efficient foam removal. Generally, foam that has been expelled is not reapplied to the laundry. The invention enables foam residue on laundry and boot gasket to be avoided while allowing the use of reduced volumes of water. In this case the invention enables automatic adjustment of the foam elimination measure to the formation of foam that has actually occurred.

BRIEF DESCRIPTION OF THE DRAWING

The invention is illustrated below with reference to FIG. 1, which is a schematic representation of the parts relevant to the invention of a drum-type washing machine in which a method according to the invention for eliminating foam can be performed. Other embodiment variants are conceivable.

DETAILED DESCRIPTION OF EXEMPLARY EMBODIMENTS OF THE PRESENT INVENTION

The drum-type washing machine of the embodiment variant shown in FIG. 1 has a detergent solution tub 1 in which a drum 2 is rotatably mounted and can be driven by means of the drive motor 14. For improved ergonomics, the axis of rotation 3 of the drum 2 is directed forward and upward from the horizontal by a small angle (e.g. 13°) so that the user of the drum-type washing machine can more easily access and see into the interior of the drum 2. Furthermore, by means of said arrangement, in cooperation with specially shaped laundry agitator paddles 4 and scoop arrangements 5 for the detergent solution 6 disposed on the inner surface of the drum jacket, a more intensive penetration of the laundry 7 with detergent solution is also achieved, together with a reduction in the free liquor, which denotes that amount of detergent solution in the detergent solution tub 1 which can no longer be absorbed by the saturated laundry (essentially below the lowest point of the drum 2).

The drum-type washing machine also has a detergent solution supply system which comprises a water connection fitting for the domestic water supply 8, an electrically controllable valve 9 and an inlet pipe 10 to the detergent solution tub 1 which optionally can also be routed via a detergent dispensing device ("dispensing drawer") 11 from which the supply water can convey portions of detergent into the detergent solution tub. Also disposed in the detergent solution tub 1 is a heater 13. The valve 9 as well as the heater 13 can be controlled by a control device ("program controller") 12 as a function of a program sequence plan which can be tied to a time program and/or to the attainment of certain measured values of parameters such as detergent solution level, detergent solution temperature, rotational speed of the drum etc. inside the drum-type washing machine. Reference numeral 15 denotes a sensor for measuring the hydrostatic pressure or its negative time gradient in the detergent solution tub 1. Reference numeral 16 denotes a detergent solution drain pump for discharging the detergent solution.

The invention claimed is:

1. A method for eliminating foam in a drum-type washing machine having a program controller for controlling a program sequence, a drum rotatably mounted in a detergent solution tub, a water supply system, a detergent solution discharge system disposed at the base of the detergent solution tub having a detergent solution drain pump, a drive motor for the drum, and a sensor for determining a foam level and/or a negative time gradient of the foam level of a liquid/air mixture contained in the detergent solution tub, the method comprising: detecting a foam level in the drum using the sensor during a run-up to a spin speed of the drum, which is a continuous or discontinuous increase in the rotational speed of the drum, during which the detergent solution pump and the sensor are switched on by the program controller; and adding a small volume of water to the drum from the water supply system during the run-up to spin speed of the drum, if a foam level is detected by the sensor.

2. The method of claim 1, wherein adding the small volume of water comprises adding the small volume of water continuously or discontinuously.

3. The method of claim 2, wherein the continuously supplied small volume of water comprises 0.5 to 1.5 l/min.

4. The method of claim 2, wherein the discontinuously supplied small volume of water comprises 0.2 to 21 in each case.

5. The method of claim 1, further comprising:

monitoring the foam level with the sensor during a spinning cycle; and controlling a rotational speed of the drum based upon the monitored foam level.

6. The method of claim 1, further comprising:

adjusting a maximum volume of water supplied during the run-up to spin speed to match an amount of laundry contained in the drum.

7. The method of claim 1, further comprising:

reducing a rotational speed of the drum until the drum comes to a stop if a maximum foam level is exceeded.

8. The method of claim 7, further comprising adjusting the maximum foam level to match an amount of laundry contained in the drum.

9. The method of claim 1, wherein the sensor comprises an optical measuring system.

10. The method of claim 1, wherein the sensor comprises a conductometric measuring system.

11. The method of claim 1, wherein the sensor comprises a capacitive measuring system.

12. The method of claim 1, wherein the sensor comprises a pressure measuring system.

13. The method of claim 12, further comprising regulating a water level during a wash and/or spin cycle with the pressure measuring system.

14. The method of claim 1, further comprising:

monitoring the foam level by the program controller using the sensor during a spinning cycle; and controlling a rotational speed of the drum by the program controller based upon the monitored foam level, wherein the program controller controls the rotational speed by reducing the rotational speed if the foam level increases, maintaining the rotational speed if the foam level is maintained, and increasing the rotational speed if the foam level decreases.

15. A method for eliminating foam in a drum-type washing machine having a program controller for controlling a program sequence, a drum rotatably mounted in a detergent solution tub, a water supply system, a detergent solution discharge system disposed at the base of the detergent solution tub having a detergent solution drain pump, a drive motor for the drum, and a sensor for determining a foam level and/or a negative time gradient of the foam level of a liquid/air mixture contained in the detergent solution tub, the method comprising: detecting a foam level during a run-up to a spin speed of the drum with the detergent solution pump switched on with the sensor;

adding a small volume of water if a foam level is detected by the sensor, monitoring the foam level with the sensor during a spinning cycle; and controlling a rotational speed of the drum based upon the monitored foam level, wherein controlling the rotational speed comprises reducing the rotational speed if the foam level increases, maintaining the rotational speed if the foam level is maintained, and increasing the rotational speed if the foam level decreases.

16. A drum-type washing machine comprising:

a program controller for controlling a program sequence;

a drum rotatably mounted in a detergent solution tub;

a detergent solution discharge system disposed at a base of the detergent solution tub having a detergent solution drain pump controlled by the program controller;

a sensor for determining a foam level and/or a negative time gradient of a liquid/air mixture contained in the detergent solution tub;

a drive motor for the drum, the program controller controlling the drive motor such that the drive motor rotates, accelerates, brakes, and/or stops a rotation of the drum to eliminate foam in the drum-type washing machine if foam is detected by the sensor during a run-up to spin speed of the drum, which is a continuous or discontinuous increase in the rotational speed of the drum, with the detergent solution drain pump switched on continuously or discontinuously; and a water supply system for adding water to the drum, the program controller controlling the water supply system such that the water supply system adds a small volume of water continuously or discontinuously during the run-up to spin speed of the drum if foam is detected by the sensor during the run-up to spin speed of the drum, wherein the detergent solution drain pump is switched on continuously or discontinuously by the program controller during the run-up to spin speed of the drum.

17. The drum-type washing machine of claim 15, wherein the program controller monitors the foam level using the sensor during a spinning cycle, wherein the program controller controls a rotational speed of the drum based upon the monitored foam level, and wherein the program controller controls the rotational speed of the drum by reducing the rotational speed if the foam level increases, maintaining the rotational speed if the foam level is maintained, and increasing the rotational speed if the foam level decreases.

* * * * *

UNITED STATES PATENT AND TRADEMARK OFFICE

CERTIFICATE OF CORRECTION

PATENT NO. : 8,510,887 B2
APPLICATION NO. : 12/671045
DATED : August 20, 2013
INVENTOR(S) : Hasse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 864 days.

Signed and Sealed this
Fifteenth Day of September, 2015

Michelle K. Lee

Michelle K. Lee
*Director of the United States Patent and Trademark Office*